US006178718B1

(12) United States Patent
Focke et al.

(10) Patent No.: US 6,178,718 B1
(45) Date of Patent: Jan. 30, 2001

(54) PACKAGING MACHINE, IN PARTICULAR FOR THE PRODUCTION OF CIGARETTE PACKS

(75) Inventors: Heinz Focke, Verden; Frank Oberschelp, Bonn, both of (DE)

(73) Assignee: Focke & Co. (GmbH & CO), Verden (DE)

( * ) Notice: Under 35 U.S.C. 154(b), the term of this patent shall be extended for 0 days.

(21) Appl. No.: 09/173,495

(22) Filed: Oct. 15, 1998

(30) Foreign Application Priority Data

Oct. 30, 1997 (DE) ..... 197 47 981

(51) Int. Cl.[7] ..... B65B 61/26
(52) U.S. Cl. ..... 53/131.4; 53/131.5; 101/216
(58) Field of Search ..... 53/131.4, 131.5; 101/216, 70

(56) References Cited

U.S. PATENT DOCUMENTS

| | | | | |
|---|---|---|---|---|
| 143,545 | * | 10/1873 | Trowbridge | 53/131.4 |
| 3,295,438 | | 1/1967 | Webb et al. . | |
| 3,693,545 | | 9/1972 | Kondur, Jr. et al. . | |
| 3,919,036 | | 11/1975 | Reinhart et al. . | |
| 3,921,516 | * | 11/1975 | Toft et al. | 101/91 |
| 4,073,122 | * | 2/1978 | Areson | 53/131.4 |
| 4,572,069 | * | 2/1986 | Schwarzbeck | 101/76 |
| 4,580,492 | | 4/1986 | Troyan et al. . | |
| 5,060,569 | * | 10/1991 | Gladow | 101/216 |
| 5,590,598 | * | 1/1997 | Keller | 101/216 |

FOREIGN PATENT DOCUMENTS

| | | |
|---|---|---|
| 2254475B2 | 5/1973 | (DE) . |
| 2733286C2 | 2/1979 | (DE) . |
| 8230779U1 | 6/1983 | (DE) . |
| 4313205C1 | 8/1994 | (DE) . |
| 4334745A1 | 4/1995 | (DE) . |
| 0084442A2 | 7/1983 | (EP) . |
| 1347664 | 2/1974 | (GB) . |
| 2142282A | 1/1985 | (GB) . |
| WO 91-10595A1 | 7/1991 | (WO) . |

* cited by examiner

*Primary Examiner*—Peter Vo
*Assistant Examiner*—Louis G. Huynh
(74) *Attorney, Agent, or Firm*—Abelman, Frayne & Schwab

(57) ABSTRACT

Packaging machine for the production of packs having at least one wrapping consisting of packaging material, the wrapping being provided with a changeable print, in particular a code. A printing mechanism (11) having printing tools (25, 26) serves for applying printing characters or codes to packaging material. These printing tools must be capable of being actuated at short time intervals in order to adapt the code. For this purpose, a printing roller (14) receiving the printing tools (25, 26) can be moved out of a working position into an adjusting position.

9 Claims, 4 Drawing Sheets

29
28
11
13
15
31
23
44
30
32
48
19
27
14
35
34
45
42
41
36/37
25
12
25
19
20
26
42
40
33
39
49
38
43
46
47

PACKAGING MACHINE, IN PARTICULAR FOR THE PRODUCTION OF CIGARETTE PACKS

BACKGROUND OF THE INVENTION

1. Field of the Invention

The invention relates to a packaging machine for the production of packs having at least one wrapping consisting of packaging material for the pack content, in particular of cigarette packs, the packs or their wrapping being provided by means of a coding assembly with a print, in particular, an identification code, to be changed from time to time.

2. Description of Related Art

Packs of the most diverse kinds are provided, during manufacture, with an identification code which reproduces, in particular, the time and place of manufacture. This code, usually consisting of numbers and letters, is applied in a position concealed from the user, specifically usually by printing a blank for the wrapping. In cigarette packs, the identification code is mostly applied to an inner wrapping which may consist of tin foil or paper.

The coding may be applied to blanks ready for packaging or to packs already completely or partially finished. It is expedient, however, for the identification code to be printed on a material web for manufacturing the blanks.

The identification code often has to be changed at short notice. In particular, it is necessary to change the code after each shift of the production factory.

SUMMARY OF THE INVENTION

The object on which the invention is based, in a packaging machine, in particular for the manufacture of cigarette packs, is to design a coding assembly in such a way that the code can be changed at little outlay and within a short time.

To achieve this object, the packaging machine according to the invention is characterized in that, in order to carry out changes in the printing, the coding assembly can be moved out of a working position into a freely accessible handling position.

According to the invention, therefore, the coding assembly is a unit capable of being handled separately, which, in a working position, carries out the printing of a material web or of blanks in the conventional way, but which can be moved in a simple way into a handling position, in order to carry out the adjustment of coding members.

In an advantageous embodiment of the invention, the coding members, namely coding discs rotatable on a shaft, are arranged on a preferably rotatably mounted carrier and the latter, together with the coding members, can be moved out of the working position in the axial direction. In the handling position, the coding members, which can be adjusted in order to change the print or the code, are changed. The unit or the coding assembly is subsequently moved back into the working position.

The coding assembly is arranged in a mounting or a housing which, according to the invention, is connected to an embossing block to form a unit. In the region of the embossing block, for example material webs consisting of tin foil are provided with embossing. The embossed material web then immediately thereafter runs through the coding assembly.

BRIEF DESCRIPTION OF THE DRAWINGS

Further details of the invention relate to the design and functioning of the coding assembly. An exemplary embodiment is explained in more detail below with reference to the drawings in which.

DETAILED DESCRIPTION OF PREFERRED EMBODIMENTS

Figure 1:
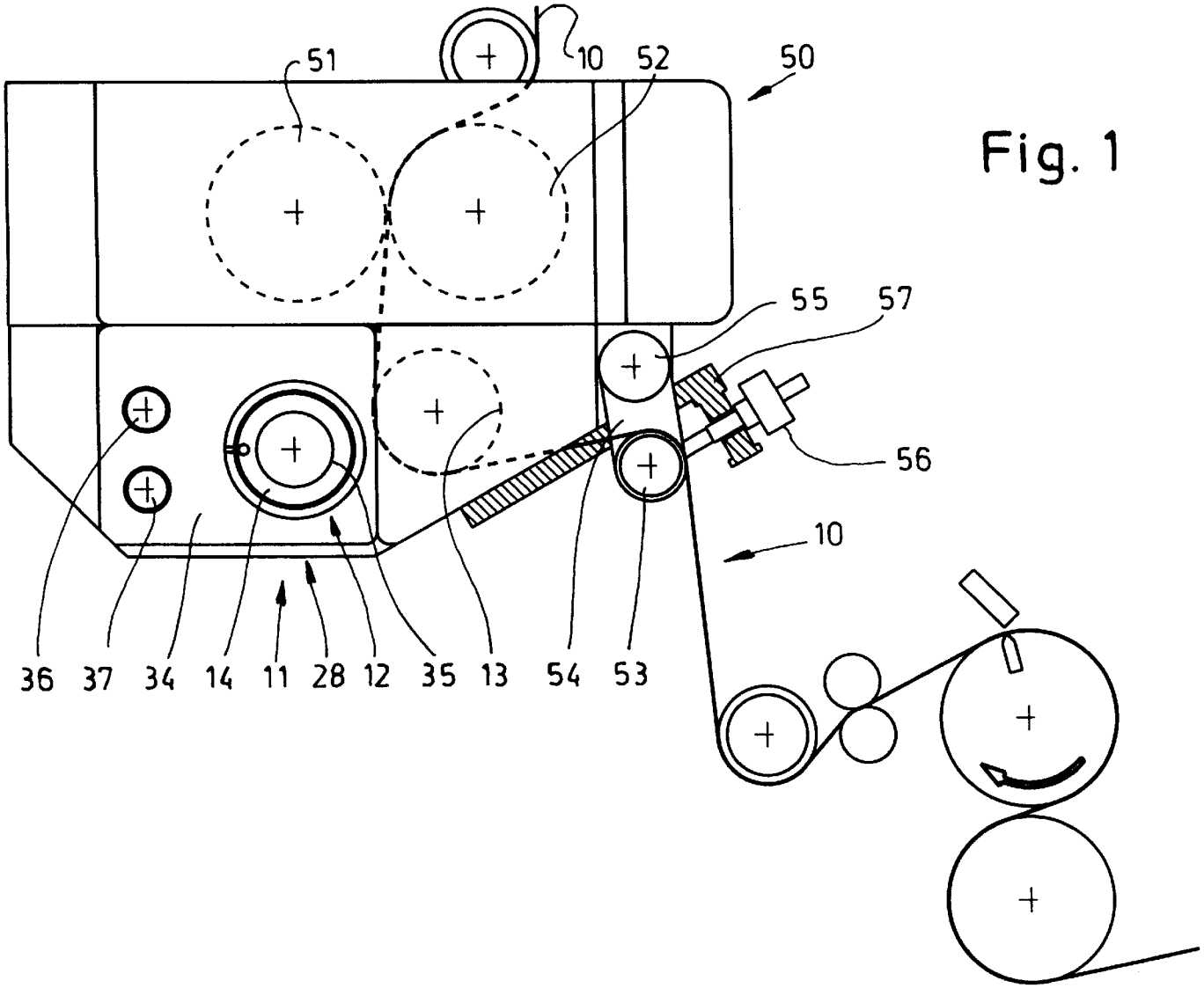
FIG. 1 shows a diagrammatic side view of a unit of a packaging machine with a coding assembly.

The exemplary embodiment illustrated in the drawings relates to an assembly which can be used in a packaging machine for cigarettes. In actual fact, what is meant is the treatment of a material web 10 for producing blanks of an inner wrapping for a cigarette group. The inner wrapping or the material web 10 may consist of paper, (thin) cardboard or tin foil, but also of a film.

The blanks are to have a print, namely a definite code capable of being changed at short notice. The latter serves, if required, for identifying the cigarette pack in terms of the time and place of manufacture. The code is applied in the correct position to the material web 10, in such a way that, in the finished pack, the corresponding data appear in the region of a bottom face of the inner wrapping.

A printing mechanism 11 serves for applying the code. This consists of a printing assembly 12 and of a back-up roller 13. The material web 10 runs through between the printing assembly 12 and the back-up roller 13. At the same time, an adjustable code is printed onto the material web 10 at intervals.

Figure 5:
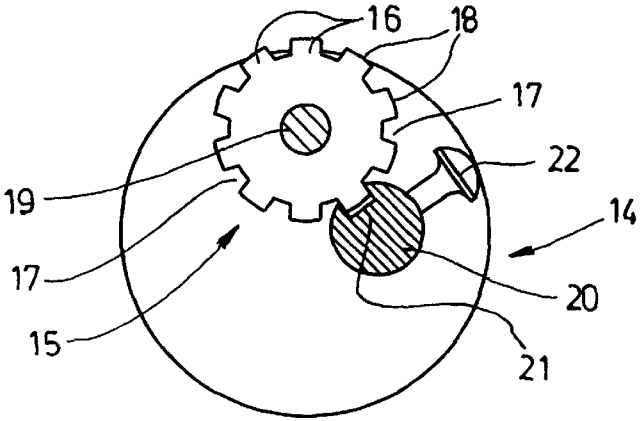
FIG. 5 shows a detail of the coding roller in cross-section.

The printing assembly 12 is mounted rotatably, that is to say in a rotating manner. Attached to a printing roller 14 are printing members which project beyond the cylindrical circumference and come to bear, according to the rotation of the printing roller 14, on the back-up roller 13 or on the material web 10 resting on the latter. The printing members are, here, printing discs 15, that is to say relatively small disc-shaped wheels, on the outer circumference of which printing characters, for example numbers or letters, are arranged. As is evident particularly from FIG. 5, the printing discs 15 are of gearwheel-like design, with radially directed projections 16 and gaps 17 formed between these. Each projection 16 carries one or more printing symbols, that is to say letters or numbers, on an outer printing face 18. Each projection 16 is expediently provided with another character. The printing discs 15 are mounted rotatably on a carrying shaft 19, so that, in each case, another symbol can be brought into the printing position by rotating the printing disc 15. In the printing position, the respective projection 16 projects beyond a cylindrical outer surface of the printing roller 14.

In the present exemplary embodiment, a plurality of printing discs 15, specifically, altogether, seven printing discs 15, are mounted on the carrying shaft 19, so as each to be independently adjustable, specifically rotatable. These are rotated on the carrying shaft 19 by hand or via a suitable tool in order to set the code. The printing discs 15 are fixed in the respective printing position, in the present case by means of a retaining member common to all the printing discs 15. This is a retaining rod 20 which extends axis-parallel to the carrying shaft 19. The retaining rod 20 is provided with a groove 21 which runs in the longitudinal direction and into which a projection 16 of each printing disc 15 penetrates positively. In order to adjust the printing discs 15, the retaining rod 20 is adjusted in the axial direction via a handle 22, specifically counter to the elastic pressure of a spring 23. When the retaining rod 20 is in an actuating position, the projections 16 of the printing discs 15 are located in the region of transversely directed recesses 24 of the retaining rod 20. The printing discs 15 can then be adjusted in the circumferential direction. After the setting operation has ended, the retaining rod 20 returns to the retaining position according to FIG. 5.

The interrelated printing discs 15, including the retaining rod 20, form a printing tool 25 for producing a complete print or a complete code. A dual-web operating mode is provided in the present exemplary embodiment. Two material webs lying next to one another or a material web 10 of double width are conveyed through the printing mechanism 11 and are acted upon simultaneously by two printing tools 25 and 26 lying next to one another in the axial direction. The common, appropriately dimensioned back-up roller 13 is assigned to both printing tools 25, 26.

The individual printing tool 25 or, as shown, both printing tools 25, 26 are mounted eccentrically on the printing roller 14. If there are two printing tools 25, 26, these are mounted next to one another in the axial direction, eccentrically to the printing roller 14, in the same circumferential position in a corresponding depression 27 of the said printing roller. The printing tools 25, 26 are arranged in such a way that, on each printing disc 15, a projection 16 having a character (letter, number) projects beyond the outer surface of the common printing roller 14 and can thus bring about printing.

Figure 2:
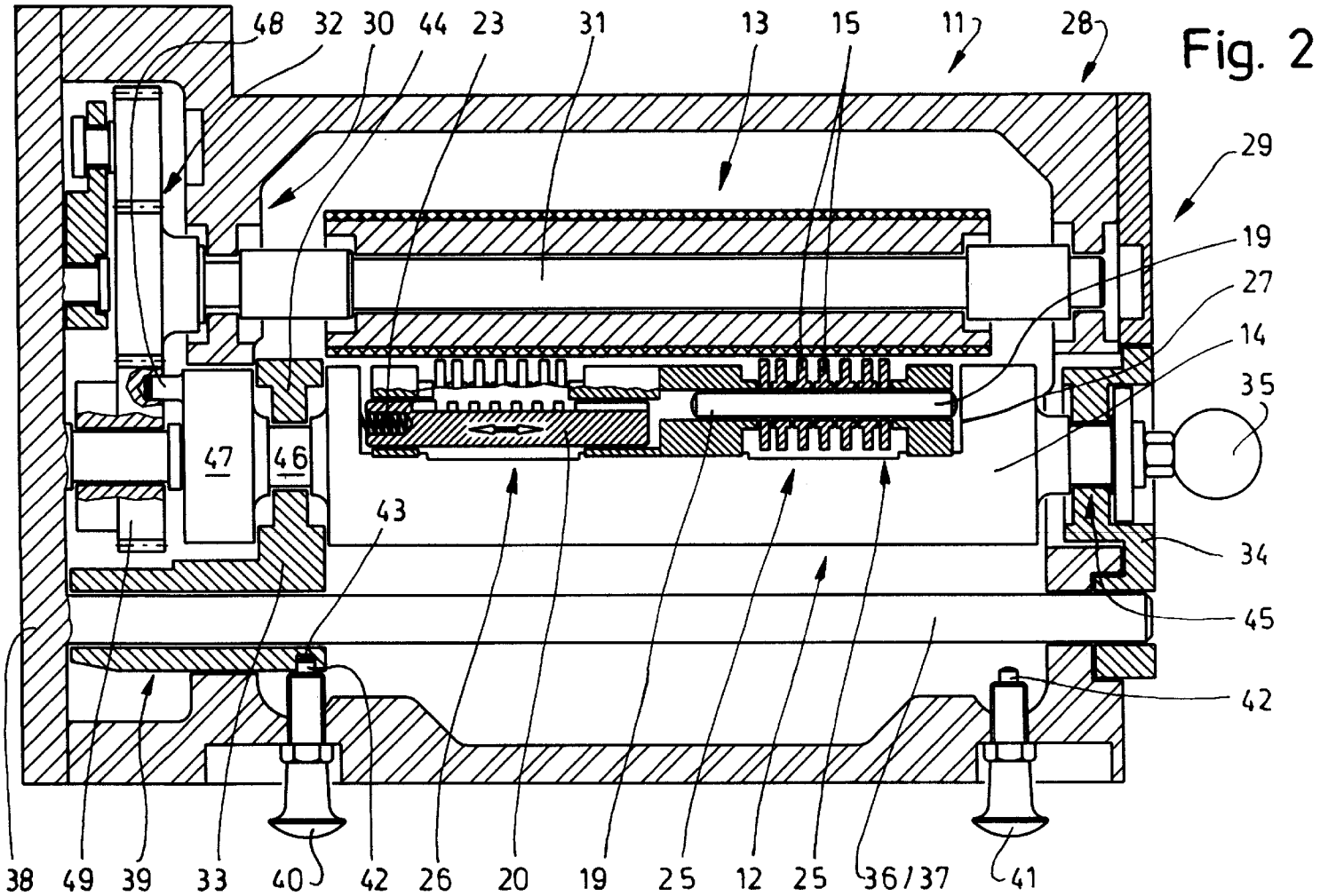
FIG. 2 shows the coding assembly in axial longitudinal section.
Figure 3:
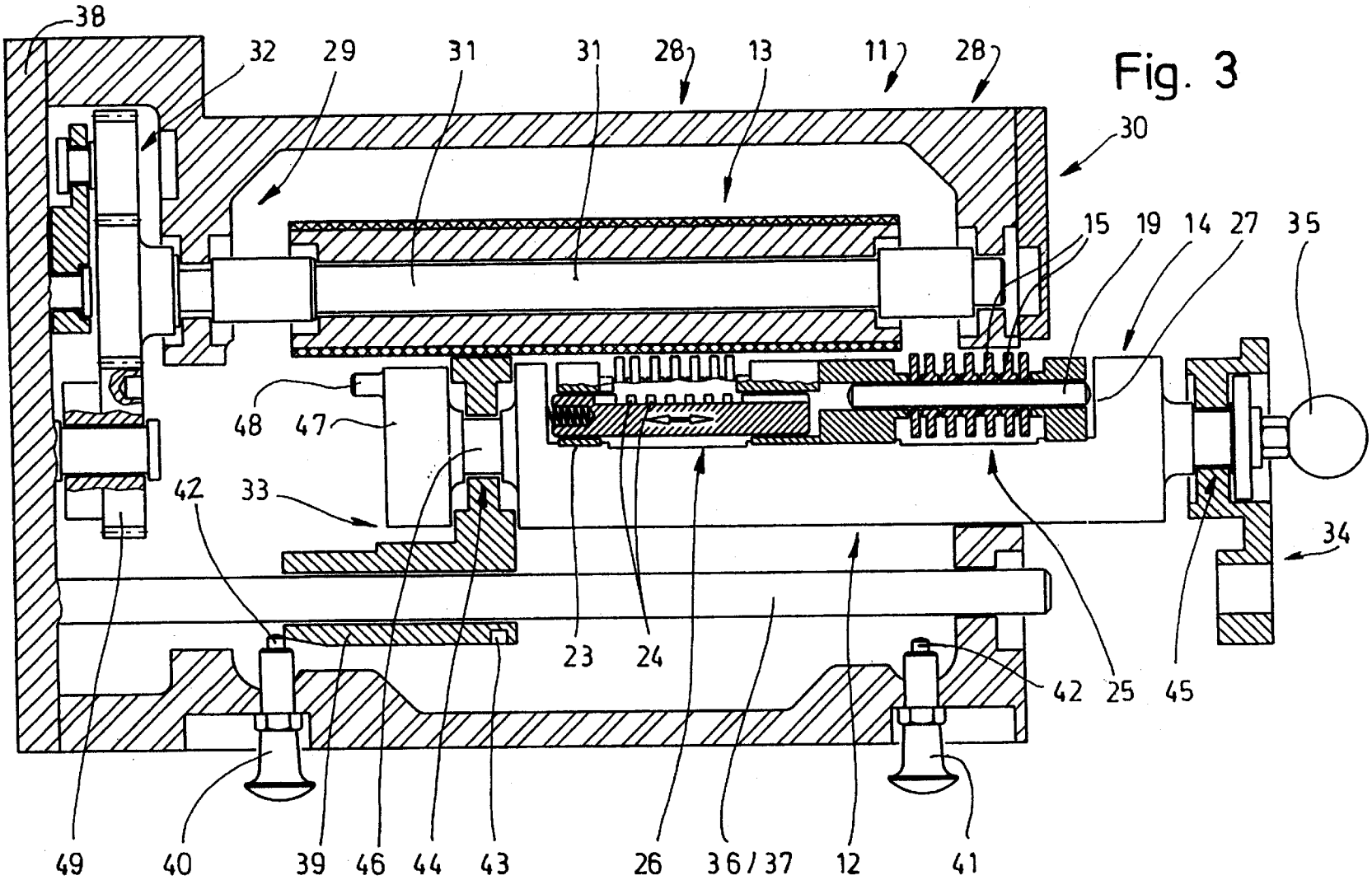
FIG. 3 shows the coding assembly according to FIG. 2, with part of the assembly in a changed position.
Figure 4:
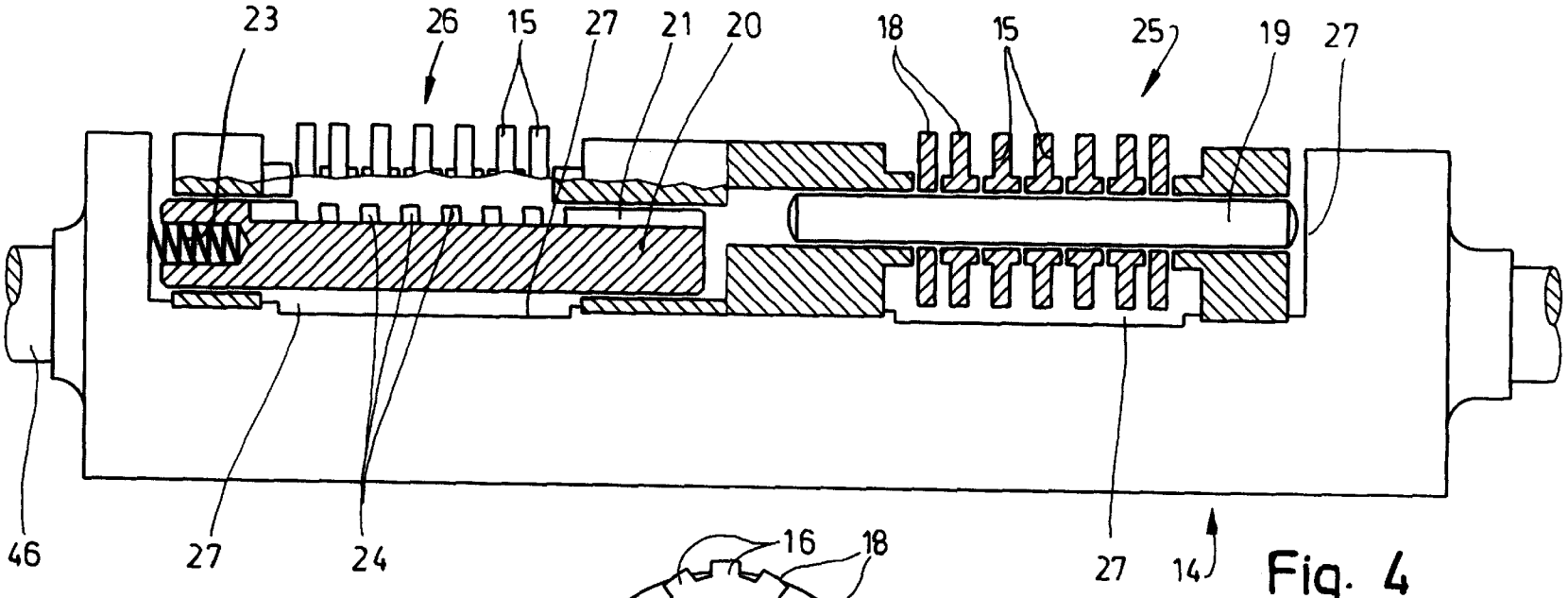
FIG. 4 shows a partially sectional side view of a coding roller as a detail of the coding assembly on an enlarged scale.

In order to adjust the printing members or printing discs 15, the printing assembly 12 can be moved as a unit out of the working position shown in FIG. 2 into a setting position. In the latter, the printing tools 25, 26 or their printing discs 15 are exposed so that (manual) adjustments can be made.

The printing mechanism 11, specifically the printing assembly 12 and back-up roller 13, is mounted in a common closed housing 28. Side walls 29, 30 serve for mounting the rotatable members, specifically the printing roller 14 and the back-up roller 13. The latter is rotatably mounted by means of a shaft 31 in a stationary (upper) part region of the side wall 29, 30. The shaft 31 is driven in rotation by a toothed gear 32. The back-up roller 13 is mounted on the shaft 31.

The printing assembly 12 or the printing roller 14 can be removed from the housing 28, specifically via a free side wall 30. For this purpose, carrying parts 33, 34 of the side walls 29, 30, together with the printing roller 14, can be displaced in the axial direction of the latter, specifically in the direction of the side located opposite the toothed gear 32. In this case, the printing assembly 12 is drawn out of the housing 28 laterally by means of a hand knob 35, in such a way that, in an end position, the (two) printing tools 25, 26 are exposed for the adjustment of the printing discs 15, specifically outside the housing 28. After the adjustments have been made, the printing assembly 12 is pushed back into the working position according to FIG. 2. At the same time, the carrying part 34 is inserted into the side wall 30 again. The opposite carrying part 33 remains in a position offset relative to the side wall 29.

The printing assembly 12 is mounted, for the movements described, on guides which ensure that, after the adjustments have been made, the printing assembly returns to the exact working position by being displaced. For this purpose, two guide rods 36, 37 are mounted at a fixed location next to one another in the lateral region of the housing 28. The two guide rods 36, 37 are connected, on the one hand, to a fixed outer wall 38 of the housing 28 and, on the other hand, to the opposite side wall 30. The printing assembly 12 is supported slidably on the guide rods 36, 37, specifically, in each case, by means of the carrying part 33, 34. The carrying part 33 located opposite the draw-out side is provided with a lengthened guide piece, specifically a guide sleeve 39 which slides on the two guide rods 36, 37 and ensures stable accurate guidance of the printing assembly 12 during the axial movements.

The two end positions of the printing assembly 12 are fixed, specifically by means of catch positions. For this purpose, for example manually operable catch members 40, 41 are provided, which penetrate with a catch pin 42 into a hole 43 of the printing assembly 12, specifically of the guide sleeve 39. FIG. 2 shows the catch position of the catch member 40 in the working position. In the drawn-out position, the catch pin 42 of the catch member 41 penetrates, adjacent to the side wall 30, into the hole 43.

In the working position, the carrying part 34 assigned to the side wall 30 is also supported on the guide rods 36, 37.

The two carrying parts 33, 34 form a rotary bearing 44, 45 for the printing roller 14. On the side facing the toothed gear 32, the printing roller 14 is provided with a shaft piece 46. Mounted on the end of the latter is a driving wheel 47. This is positively connected via a journal 48 to a gearwheel 49 of the toothed gear 32. The driving wheel 47 and journal 48 thus couple the printing assembly 12 to the drive, the said coupling being capable of being released and reconnected in a simple way.

The printing mechanism 11 is connected to an embossing assembly 50 for the material web 10. The embossing assembly 50 serves for the embossing treatment of the material web 10, for example for the embossing of tin foil. In this case, the material web 10 is guided through between two co-operating embossing rollers 51, 52. After the embossing operation, the material web 10 runs through the printing mechanism 11 for applying the print or the code.

In this exemplary embodiment, the embossing rollers 51, 52 are mounted next to one another in a horizontal plane. The printing mechanism 11 is arranged below the embossing assembly 50. The housing 28 of the printing mechanism 11 is expediently connected to the embossing assembly 50 or its housing.

As is evident from FIG. 1, the printing roller 14 and back-up roller 13 are positioned next to one another so as to be slightly offset relative to one another vertically. The guide rods 36, 37 are positioned one above the other.

The material web 10 is deflected by the back-up roller 13 and emerges from the printing mechanism 11 in an approximately horizontal direction. The material web 10 runs over a deflecting roller 53 which is adjustable. For this purpose, the deflecting roller 53 is mounted on a lever 54. The latter can be moved about a pivot bearing 55. An adjusting member makes it possible to adjust the lever 54. This adjusting member is a knurled screw 56 which is mounted on a stationary holder 57 and one end of which bears on the lever 54.

The printing mechanism 11 may alternatively also be designed in such a way that the members responsible for printing, that is to say the printing tools 25, 26 or the printing roller 14, can be moved out of the working position into an adjusting position by means of an axially transverse movement.

What is claimed is:

1. A packaging machine for producing packs having their contents wrapped in a packaging material having information printed thereon, which printed information can be changed from time to time as desired, said machine comprising:

a housing;

a back-up roller mounted within said housing; and for providing access to said printing tool outside said housing to permit changes to be made to said information.

2. The packaging machine of claim 1, wherein said printing roller being rotatably mounted on two carrying parts, said carrying parts having portions for mounting on a pair of stationary guide rods mounted to said housing parallel to said rotational axis of said printing roller for permitting sliding movement of said printing roller between said working position and said handling position.

3. The packaging machine of claim 2, wherein one of said carrying parts fits flush with a side wall of said housing when said printing roller is in said working position.

4. The packaging machine of claim 1, wherein said printing roller further includes catch members for releasably retaining said printing roller in said working position and in said handling position.

5. The packaging machine of claim 1, further comprising a plurality of printing tool wherein each said printing tool comprises a plurality of printing discs rotatably mounted on a common shaft for adjustment of each disc independently of the other discs to change said information.

6. The packaging machine of claim 5, wherein each said printing tool further comprises a retaining rod mounted for movement into and out of engagement with said printing discs between a locking position wherein said printing discs are held in place and an unlocked position wherein said printing discs can be rotated on said common shaft to permit a change of said information.

7. The packaging machine of claim 1, further comprising two said printing tools mounted side by side on said printing roller in an axial direction relative to said rotational axis thereof, each said printing tool being mounted eccentrically on said printing roller relative to said rotational axis thereof in a depression therein.

8. The packaging machine of claim 1, wherein said printing roller further includes a coupling member for cooperating with a gear wheel mounted to said housing for automatically coupling said printing roller to a drive member when said printing roller is moved to said working position.

9. The packaging machine of claim 1, wherein said packs are cigarette packs.

* * * * *